US012331478B2

(12) United States Patent
Panik et al.

(10) Patent No.: US 12,331,478 B2
(45) Date of Patent: Jun. 17, 2025

(54) MODULAR DRIVING HEAD MANDREL SYSTEMS AND METHODS FOR SHEET PILING INSTALLATION

(71) Applicant: CMI LIMITED CO., Marietta, GA (US)

(72) Inventors: Keith Panik, Ball Ground, GA (US); Steve Hargrave, Roswell, GA (US); Mike Smith, Talking Rock, GA (US)

(73) Assignee: CMI LIMITED CO., Marietta, GA (US)

( * ) Notice: Subject to any disclaimer, the term of this patent is extended or adjusted under 35 U.S.C. 154(b) by 265 days.

(21) Appl. No.: 18/173,225

(22) Filed: Feb. 23, 2023

(65) Prior Publication Data

US 2023/0265630 A1 Aug. 24, 2023

Related U.S. Application Data

(60) Provisional application No. 63/313,062, filed on Feb. 23, 2022.

(51) Int. Cl.

| | |
|---|---|
| ***E02D 7/06*** | (2006.01) |
| ***E02D 5/02*** | (2006.01) |
| ***E02D 7/18*** | (2006.01) |

(52) U.S. Cl.

CPC ..... *E02D 7/06* (2013.01); *E02D 5/02* (2013.01); *E02D 7/18* (2013.01)

(58) Field of Classification Search

CPC .... E02D 7/02; E02D 7/06; E02D 7/14; E02D 7/18

See application file for complete search history.

(56) References Cited

U.S. PATENT DOCUMENTS

| | | | | | |
|---|---|---|---|---|---|
| 3,783,954 | A * | 1/1974 | Bodine | E02D 7/18 | 173/49 |
| 4,436,452 | A * | 3/1984 | Bodine | E02D 7/18 | 299/14 |
| 5,030,034 | A * | 7/1991 | Bodine | B09C 1/002 | 405/129.7 |
| 5,503,503 | A * | 4/1996 | Glass | E02D 5/02 | 405/274 |
| 5,803,672 | A * | 9/1998 | Glass | E02D 7/14 | 405/232 |
| 6,386,295 | B1 * | 5/2002 | Suver | E02F 3/962 | 173/1 |
| 6,942,430 | B1 * | 9/2005 | Suver | E02D 7/22 | 405/253 |
| 7,914,237 | B2 * | 3/2011 | Glass | E02D 7/20 | 405/274 |
| 8,753,043 | B2 * | 6/2014 | Irvine | E02D 5/04 | 405/274 |
| 9,249,551 | B1 * | 2/2016 | White | E02D 11/00 | |
| 10,024,019 | B1 * | 7/2018 | Hunter | E02D 5/56 | |
| 10,119,234 | B1 * | 11/2018 | Yeany | E02D 5/03 | |
| 2020/0316646 | A1 * | 10/2020 | Janes | E02D 7/18 | |
| 2021/0108388 | A1 * | 4/2021 | Collins | E02D 13/00 | |

* cited by examiner

*Primary Examiner* — Frederick L Lagman
(74) *Attorney, Agent, or Firm* — Perilla Knox & Hildebrandt LLP

(57) ABSTRACT

A modular driving head coupling device includes a first component configured for attachment to a driving equipment apparatus such as a vibratory hammer, and a second component configured for attachment to an installation equipment apparatus such as a sheet piling installation mandrel, including detachable coupling elements for detachable coupling between the first and second components.

13 Claims, 5 Drawing Sheets

MODULAR DRIVING HEAD MANDREL SYSTEMS AND METHODS FOR SHEET PILING INSTALLATION

CROSS-REFERENCE TO RELATED APPLICATION

This application claims the benefit of U.S. Provisional Patent Application Ser. No. 63/313,062 filed Feb. 23, 2022, the entirety of which is hereby incorporated herein by reference for all purposes.

TECHNICAL FIELD

The present invention relates generally to systems and methods for installation of ground-embedded structures, and more particularly to a modular driving head system for coupling vibratory hammers or impact hammers to mandrels for placing sheet pilings to form retaining walls and other structures.

BACKGROUND

Various devices are used to connect vibratory hammers to driving equipment. For example, driving heads are used to connect vibratory hammers to mandrels for installing sheet piling to form retaining walls, cut-off walls, or other structures into the ground. Driving heads having an integrated design may be difficult and time consuming to repair and may also be impractical to repair or replace in the field, leading to expensive downtime and project delays. This also standardizes the driving head across many devices.

Accordingly, it can be seen that needs exist for improved driving equipment and methods for coupling drive equipment such as vibratory hammers to installation equipment such as mandrels for use in the installation of sheet pilings and other embedded structures. It is to the provision of improved driving equipment and methods meeting these and other needs that the present invention is primarily directed.

SUMMARY

In example embodiments, the present invention provides improved modular driving head devices, systems, and methods for coupling driving equipment such as vibratory hammers with installation equipment such as mandrels for installing sheet piling and other ground-embedded structures. In further example embodiments, the modular driving head device may detachably couple driving equipment such as vibratory hammers to installation equipment such as mandrels, punches, and/or other devices, to allow for equipment repair and change-out more quickly and easily than traditional integrated driving head designs, potentially reducing project delays and expense.

In one aspect, the invention relates to a modular driving head device including a first component configured for attachment to a driving equipment apparatus, a second component configured for attachment to an installation equipment apparatus, and detachable coupling means for detachable coupling between the first and second components.

In another aspect, the present invention relates to a modular driving head device. In example forms, the modular device preferably includes a modular head weldment and coupling shaft, as well as a cradle weldment and a coupling sleeve. The head weldment is configured for engagement with driving equipment and the cradle weldment is configured for engagement with installation equipment. The coupling shaft is configured to be received and engaged within the coupling sleeve do detachably couple the modular head weldment with the cradle weldment.

In another aspect, the invention relates to a method of coupling two pieces of equipment. The method preferably includes rigidly attaching a first piece of equipment to a modular head weldment with a coupling shaft, and positioning the first piece of equipment so that the coupling shaft lay substantially within a coupling sleeve rigidly attached to a second piece of equipment with an attached cradle weldment, and fastening the head weldment to the cradle weldment In still another aspect, the invention relates to a method of connecting two pieces of equipment. The method preferably includes connecting a first piece of equipment to a head weldment with a coupling shaft, connecting a cradle weldment and coupling sleeve to a second piece of equipment, and joining the head weldment and cradle weldment such that the coupling shaft lies substantially within the coupling sleeve.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of example embodiments are explanatory of example embodiments of the invention, and are not restrictive of the invention, as claimed.

DETAILED DESCRIPTION OF EXAMPLE EMBODIMENTS

The present invention may be understood more readily by reference to the following detailed description of example embodiments taken in connection with the accompanying drawing figures, which form a part of this disclosure. It is to be understood that this invention is not limited to the specific devices, methods, conditions, or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1:
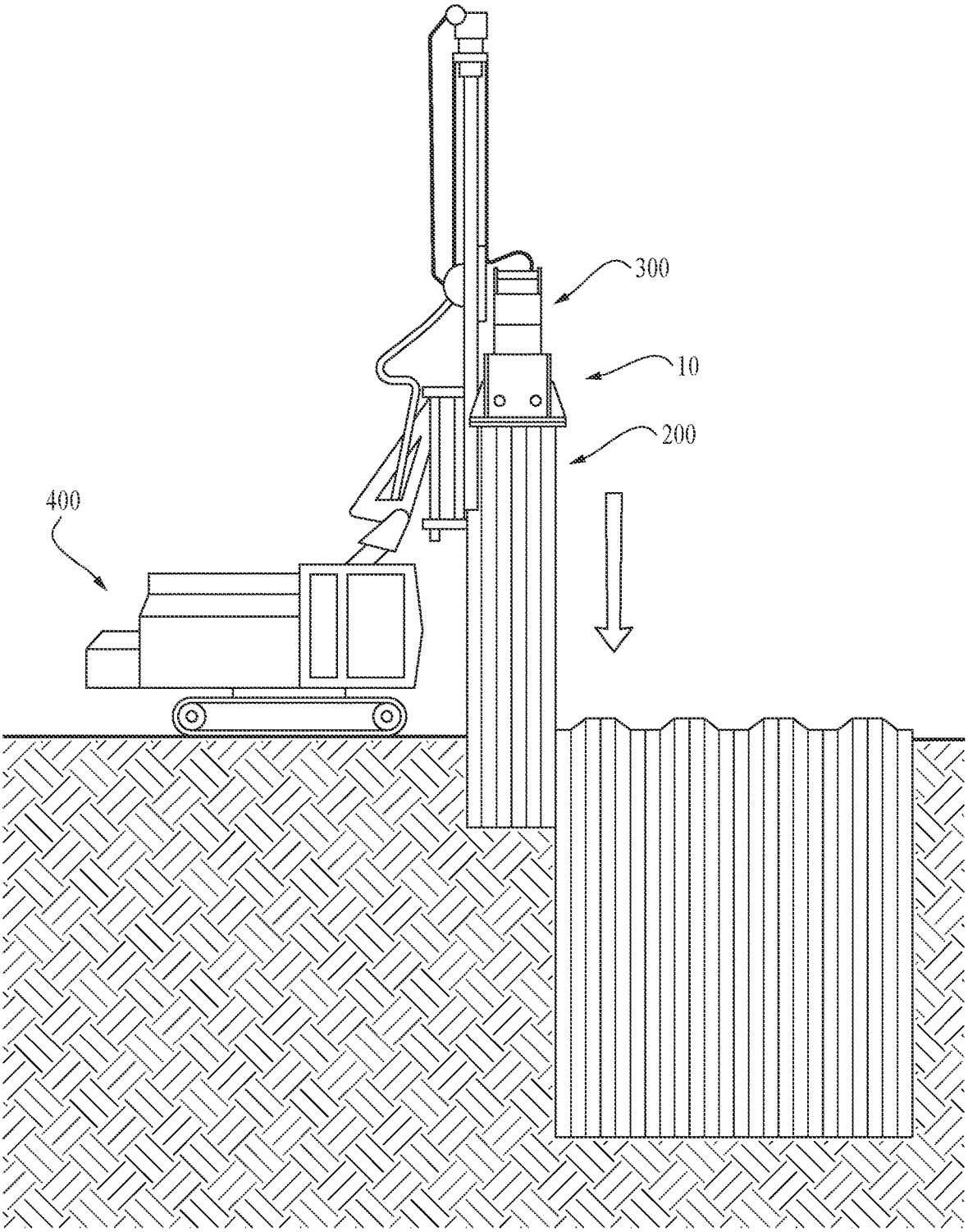
FIG. 1 shows the modular connecting head device in use with other components of an installation system according to an example embodiment of the present disclosure.

With reference now to the drawing figures, wherein like reference numbers represent corresponding parts throughout the several views, FIG. 1 shows an installation system comprising a modular driving head 10 according to an example embodiment of the present invention. In the example shown in FIG. 1, a modular head 10, as described in greater detail below, is used to transfer the force from a vibratory hammer 300 held by a supporting device or equipment 400 (such as for example a crane, an excavator mount, an excavator bucket, a mobile ram, a fixed lead, or other support device or means) into a mandrel 110 onto which a sheet piling 200 is mounted for placement, thereby driving the mandrel and attached sheet piling 200 into the ground. Once the sheet piling 200 is attached and in position, the mandrel 110 is hoisted from the ground via the attached modular head, and a new piece of sheet piling 200 is attached to the mandrel.

Figure 2:
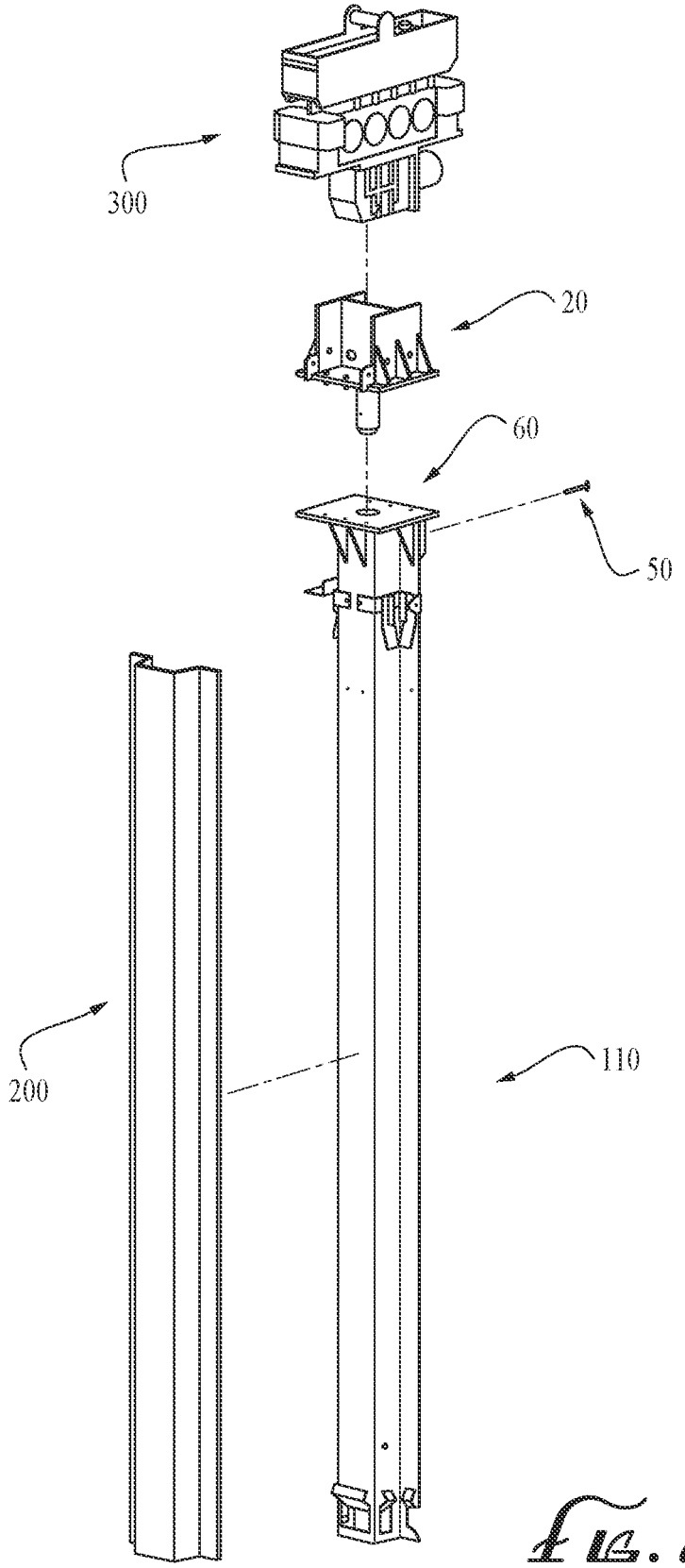
FIG. 2 shows an assembly view of components of the system of FIG. 1.

FIG. 2 shows an assembly view of the system, including a vibratory hammer 300, a modular head 10, a mandrel 110, and a sheet piling 200. In the example embodiment shown in FIG. 2, the modular head 10 further comprises a modular head weldment 20 and a modular cradle weldment 60, which are removably coupled together. The vibratory hammer 300 attaches to the head weldment 20, while the cradle weldment 60 attaches to the mandrel 110.

Figure 3:
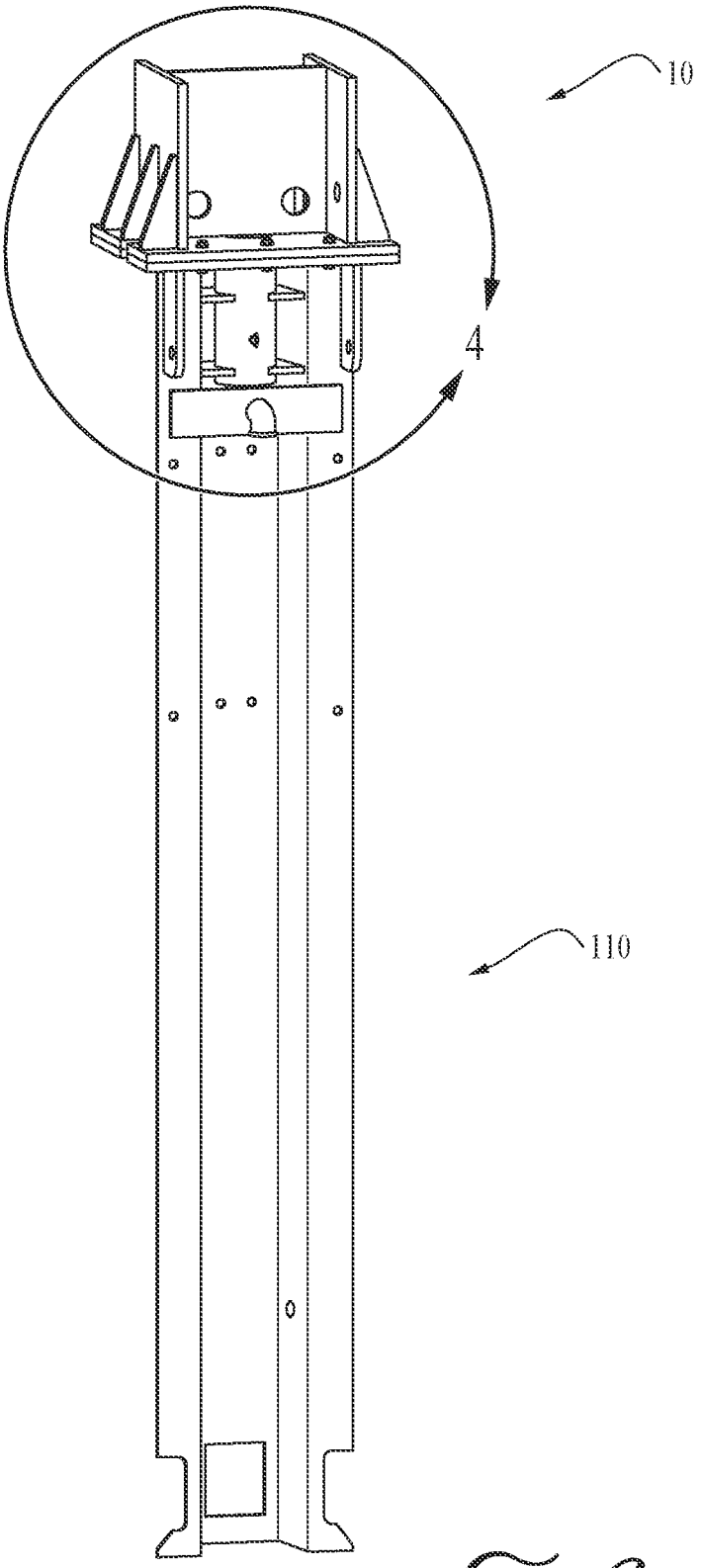
FIG. 3 shows the modular driving head system engaged with a sheet piling installation mandrel according to an example embodiment of the present invention.
Figure 4:
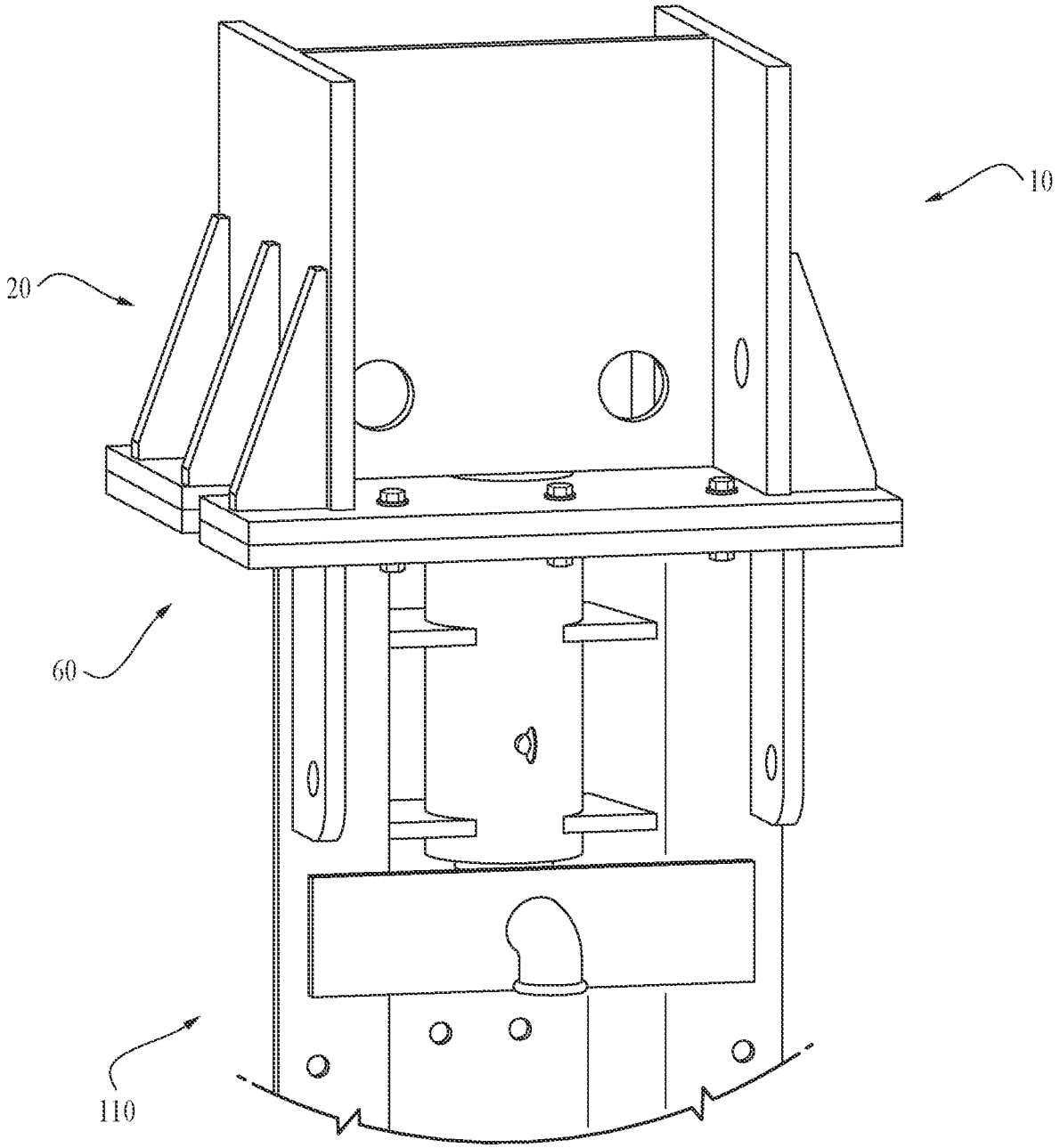
FIG. 4 is a perspective view of a modular connecting head device according to FIG. 3.
Figure 5:
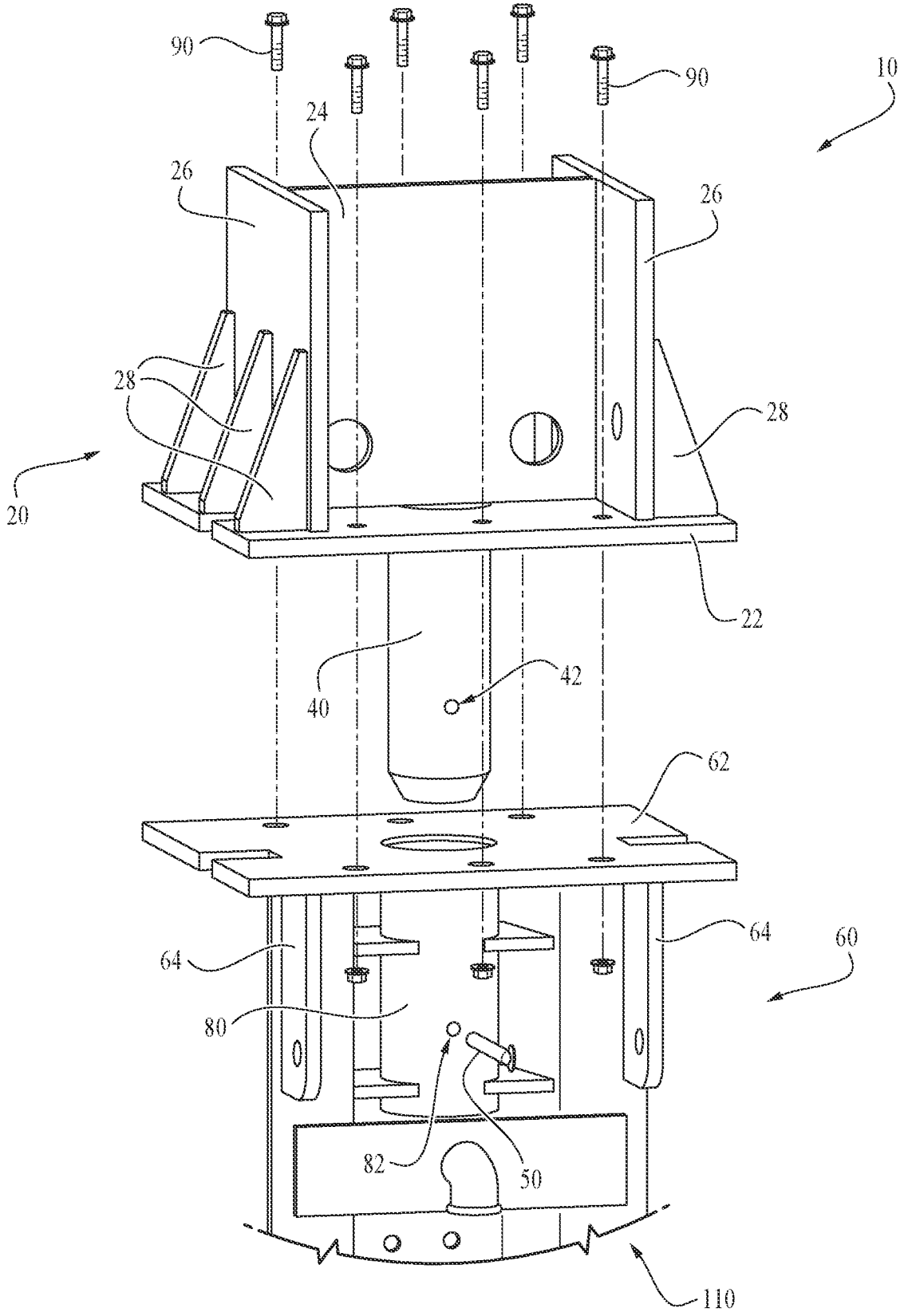
FIG. 5 is a detailed assembly view of the modular driving head system according to FIG. 3.

FIG. 3 shows an example embodiment of an assembled modular driving head device 10 connected to a mandrel 110. FIG. 4 shows a close-up view of the assembled modular driving head device 10 shown in FIG. 3. Similarly, FIG. 5 shows a further detailed assembly view of the driving head device 10 shown in FIG. 4.

In example embodiments, the modular head weldment 20 comprises a coupling shaft 40, and the modular cradle weldment 60 comprises a coupling sleeve 80. During use, the modular head weldment 20 and the modular cradle weldment 60 are positioned such that the coupling shaft 40 is received or engaged at least partially, and preferably engaged substantially within the coupling sleeve 80. The modular head weldment and the modular cradle weldment may then be semi-permanently but detachably joined together by fasteners 90, such as bolts (in example embodiments, ⅝" bolts, larger or smaller bolts, screws, clamps, clips, fasteners, couplings, or any other suitable detachable or releasable coupling means.

In the depicted example embodiment, the head weldment 20 further comprises a head base plate 22, a bite plate 24 extending perpendicularly away from the face of the head base plate, and two support plates 26 on either side of the bite plate, which may be orthogonal to both the head base plate 22 and bite plate 24. The head weldment may also comprise one or more, for example several buttress plates 28 between, and generally orthogonal to, the head base plate 22 and the free faces of the support plates 26. The coupling shaft 40 may be welded or otherwise attached to the head base plate 22 opposite the bite plate 24 and extend perpendicularly away from the head base plate 22.

In some example embodiments, the coupling sleeve 80 and the cradle weldment 60 may be attached to a mandrel 110. The cradle weldment 60 may comprise a cradle baseplate 62 and two support gussets 64 extending perpendicularly away from the cradle base plate and along the mandrel 110. The coupling sleeve 80 may be rigidly attached or integrated to the mandrel 110 such that it abuts the cradle base plate 62 and runs parallel to the support gussets 64. Alternatively, the coupling sleeve 80 may be rigidly attached or integrated to the cradle weldment 60.

The coupling shaft 40 and coupling sleeve 80 may include one or more shear pin holes 42 and 82, respectively, positioned to align with one another when the head weldment 20 is fully engaged with the cradle weldment 60, to receive a shear pin 50 or other attachment member. In some particular example embodiments, the coupling shaft 40 is about 6" in diameter and about 14" long, and in other example embodiments about 8" diameter and about 16" long. The coupling sleeve 80 is configured with corresponding dimensions to receive and engage the coupling shaft with a running or sliding fit. In other example embodiments, larger or smaller diameter and/or length dimensions may be utilized. Optionally, the coupling shaft 40 and/or the coupling sleeve 80 may be tapered to ease assembly and/or provide a more closely engaging fit.

The modular head unit may also allow for switching between multiple cradle units coupled to different installation equipment components, allowing an operator to quickly change between different units of the same type of driven installation equipment or to different types of driven installation equipment altogether. Additionally, should any part of the modular head weldment, coupling shaft, modular cradle weldment, or coupling sleeve become damaged, the modular head unit and coupling shaft can be separated from the modular cradle weldment and coupling sleeve, as well as any attached equipment, so that the damaged part may be repaired or replaced. As the part needing repair may be smaller and more maneuverable than the driving head as a whole, repairs may be made more quickly, easily and economically than they otherwise could have been using traditional equipment.

A plurality of driving devices can be attached one at a time by lining up and sliding the modular head coupling shaft 42 into the coupling sleeve 80 of the driving device until the pin holes 42, 82 are aligned. A shear pin 50 is inserted and the head plates 22, 62 are bolted together by installing one or more nuts and bolts or other releasable fasteners 90. The coupled system can now be used as a single driving device. To change the driving device 110, the head plates 22 and 62 are un-bolted by disengagement of the fasteners 90 and the shear pin 50 is removed. The head 10 can now be slid out from the driving device 110 and a different driving device attached.

While the invention has been described with reference to example embodiments, it will be understood by those skilled in the art that a variety of modifications, additions and deletions are within the scope of the invention, as defined by the following claims.

What is claimed is:

1. A modular driving head device comprising a first component configured for attachment to a driving equipment apparatus, a second component configured for attachment to an installation equipment apparatus, and detachable coupling means for detachable coupling between the first and second components;

wherein the detachable coupling means comprises a coupling shaft extending from the first component, and a coupling sleeve portion of the second component, wherein the coupling shaft is configured for sliding engagement within the coupling sleeve; and wherein the coupling shaft and coupling sleeve each comprise cooperating holes configured for alignment with one another when the first component and the second component are engaged, and wherein the detachable coupling means further comprises an engagement pin configured for engagement within the cooperating holes of the coupling shaft and the coupling sleeve.

2. The modular driving head device of claim 1, wherein the driving equipment apparatus comprises a vibratory hammer, and wherein the installation equipment apparatus comprises a sheet piling installation mandrel.

3. A modular driving head device comprising a first component configured for attachment to a driving equipment apparatus, a second component configured for attachment to an installation equipment apparatus, and detachable coupling means for detachable coupling between the first and second components; and wherein the detachable coupling means comprises a first head plate portion of the first component and a second head plate portion of the second component, the first head plate comprising a first array of bolt holes and the second head plate comprising a second array of bolt holes, wherein the first and second arrays of bolt holes are configured to align with one another when the first and second components are engaged; and further comprising a plurality of bolts for placement through the first and second arrays of bolt holes to couple the first head plate to the second head plate.

4. The modular driving head device of claim 3, wherein the driving equipment apparatus comprises a vibratory hammer, and wherein the installation equipment apparatus comprises a sheet piling installation mandrel.

5. A modular driving head device comprising:

a modular head weldment configured for attachment to a vibratory hammer, the modular head weldment comprising a coupling shaft extending axially outward from the modular head weldment and further comprising a head base plate, a bite plate, two support plates, and a plurality of buttress plates; and a modular cradle weldment configured for attachment to a sheet piling installation mandrel, the modular cradle weldment comprising a coupling sleeve configured to receive the coupling shaft.

6. The device of claim 5, wherein the coupling shaft is rigidly attached to the cradle weldment.

7. The device of claim 5, wherein the modular head weldment is configured for detachable coupling to the modular cradle weldment.

8. A modular driving head device comprising:

a modular head weldment configured for attachment to a vibratory hammer, the modular head weldment comprising a coupling shaft extending axially outward from the modular head weldment;

a modular cradle weldment configured for attachment to a sheet piling installation mandrel, the modular cradle weldment comprising a coupling sleeve configured to receive the coupling shaft and a cradle baseplate.

9. The device of claim 8, wherein modular head weldment further comprises a head base plate and a bite plate.

10. The device of claim 9, wherein the modular head weldment further comprises two support plates.

11. The device of claim 9, wherein the coupling shaft is rigidly attached to the cradle weldment.

12. The device of claim 9, wherein the modular head weldment is configured for detachable coupling to the modular cradle weldment.

13. The device of claim 8, wherein the cradle weldment further comprises two support gussets.

* * * * *